US009102439B2

(12) United States Patent
Kemper et al.

(10) Patent No.: US 9,102,439 B2
(45) Date of Patent: Aug. 11, 2015

(54) STACKABLE CUP ASSEMBLY

(75) Inventors: Bernard J. Kemper, Bonne Terre, MO (US); Charles H. Miller, Barnhart, MO (US); Janine Berger, Hoboken, NJ (US)

(73) Assignee: Handi-Craft Company, St. Louis, MO (US)

( * ) Notice: Subject to any disclaimer, the term of this patent is extended or adjusted under 35 U.S.C. 154(b) by 331 days.

(21) Appl. No.: 13/267,501

(22) Filed: Oct. 6, 2011

(65) Prior Publication Data

US 2012/0085674 A1 Apr. 12, 2012

Related U.S. Application Data

(60) Provisional application No. 61/391,441, filed on Oct. 8, 2010.

(51) Int. Cl.

| | |
|---|---|
| ***B65D 6/28*** | (2006.01) |
| ***A47G 19/00*** | (2006.01) |
| ***B65D 21/00*** | (2006.01) |
| ***B65D 21/02*** | (2006.01) |
| ***B65D 43/02*** | (2006.01) |

(52) U.S. Cl.

CPC ..... *B65D 21/0228* (2013.01); *B65D 43/0229* (2013.01); *B65D 2543/00092* (2013.01); *B65D 2543/0099* (2013.01); *B65D 2543/00296* (2013.01); *B65D 2543/00351* (2013.01); *B65D 2543/00518* (2013.01); *B65D 2543/00546* (2013.01); *Y10T 29/49826* (2015.01)

(58) Field of Classification Search

CPC ..... B65D 11/04; B65D 21/0209; B65D 21/0217; B65D 21/0213; B65D 21/0215; B65D 21/0219; B65D 21/0224; B65D 2543/00972; B65D 21/0228

USPC ..... 220/4.27, 505, 507, 4.24–4.26, 220/23.83–23.86, 23.88, 23.89, 320; 215/10; 206/509, 430, 217, 546, 503; D9/746, 741

See application file for complete search history.

(56) References Cited

U.S. PATENT DOCUMENTS

| | | | | | |
|---|---|---|---|---|---|
| 63,138 | A | * | 3/1867 | Chapman | 215/10 |
| 769,615 | A | | 9/1904 | Kosansvich | |
| 1,082,892 | A | | 12/1913 | Milligan et al. | |
| 2,328,543 | A | * | 9/1943 | Bauman | 206/499 |
| 2,960,248 | A | | 11/1960 | Kuhlman | |
| 3,067,896 | A | * | 12/1962 | Berg et al. | 215/12.1 |
| 3,369,691 | A | | 2/1968 | Tohchung | |
| D244,256 | S | | 5/1977 | Dekker | |
| 4,444,324 | A | * | 4/1984 | Grenell | 215/6 |

(Continued)

OTHER PUBLICATIONS http://www.williams-sonoma.com/wsimgs/ab/images/dp/wcm/201029/0004/img821.jpg; Sep. 13, 2010; 2 pages.

(Continued)

*Primary Examiner* — Shawn M Braden

(74) *Attorney, Agent, or Firm* — Armstrong Teasdale LLP

(57) ABSTRACT

A cup assembly configured to be coupled to a second cup assembly is provided. The cup assembly includes a container having an open top, a closed bottom base, and a sidewall extending between the open top and the base. The open top, the base, and the sidewall define a cavity of the container. The cup assembly further includes a lid configured to removably couple to the container. The lid includes a lower portion configured to be received within the cavity of the container to couple the lid to the container.

16 Claims, 27 Drawing Sheets

(56) References Cited

U.S. PATENT DOCUMENTS

| | | | | |
|---|---|---|---|---|
| 4,598,832 | A * | 7/1986 | Alonso | 215/6 |
| D323,615 | S | 2/1992 | Carlstrom | |
| 5,339,975 | A * | 8/1994 | Stoner | 220/4.27 |
| D350,460 | S * | 9/1994 | Picozza et al. | D7/629 |
| 5,417,327 | A * | 5/1995 | Saumure | 206/427 |
| 5,887,740 | A | 3/1999 | Hong | |
| 6,185,807 | B1 * | 2/2001 | Kazmierczak et al. | 29/450 |
| D466,814 | S | 12/2002 | Hurlburt | |
| D485,017 | S | 1/2004 | Noh | |
| D487,697 | S | 3/2004 | Rosen | |
| D572,592 | S | 7/2008 | Chang | |
| D605,529 | S | 12/2009 | Holtrop | |
| 7,866,500 | B1 * | 1/2011 | Peggs | 220/6 |
| D641,257 | S | 7/2011 | Thiebaut et al. | |
| D641,629 | S | 7/2011 | Miceli et al. | |
| 2007/0012693 | A1 | 1/2007 | Kummer | |
| 2008/0017642 | A1 | 1/2008 | King | |

OTHER PUBLICATIONS http://www.bebeccino.com/boutique/images/D/zoli_onthego_snack_formula_dispencer_80...; "Zo li"; Sep. 13, 2010; 1 page.

http://www.packinsmart.com/How_To_Use.html; "How to Use"; Sep. 13, 2010/ 2 pages.

http://www.packinsmart.com/Home.html "Home Page"; Oct. 3, 2011; 1 page.

http://www.innobaby.com/Packin-SMART-Stack-N-Seal-4-Teir-Tray..."innobaby" copyright 2011 INNOBABY LLC.; Oct. 3, 2011; 1 page.

http://ep.yimg.com/ca/l/bestbabygear_2116_17018306; Sep. 13, 2010; 1 page.

International Search Report and Written Opinion issued in PCT Application No. PCT/US2011/055385, mailed Feb. 21, 2012, 13 pages.

* cited by examiner

STACKABLE CUP ASSEMBLY

CROSS REFERENCE TO RELATED APPLICATIONS

This application claims the benefit of U.S. Provisional Application No. 61/391,441 filed Oct. 8, 2010, which is hereby incorporated by reference in its entirety.

FIELD

The field of the invention relates generally to stackable cup or container assemblies.

BACKGROUND

At least some known containers are configured to stack by attaching a bottom of a first container to a top of a second container. One such assembly of stackable containers includes a plurality of containers configured to snap or click together. More specifically, the bottom of a first container snaps into and out of engagement with the top of a second container to stack the containers. However, such a snap engagement does not form a water-tight seal and, as such, the containers are used to store dry products therein.

Another known assembly of stackable containers includes containers that couple together by coupling the bottom of the first container about an outer surface of the top of the second container. More specifically, an inner surface of the bottom of the first container and the outer surface of the top of second container are threaded for engagement with each other. As such, the first container includes a bottom projecting flange that reduces the volume of the container that is used to store a product therein.

SUMMARY

In one aspect, a cup assembly configured to be coupled to a second cup assembly is provided. The cup assembly includes a container having an open top, a closed bottom base, and a sidewall extending between the open top and the base. The open top, the base, and the sidewall define a cavity of the container. The cup assembly further includes a lid configured to removably couple to the container. The lid includes a lower portion configured to be received within the cavity of the container to couple the lid to the container.

In another aspect, a stackable cup assembly is provided. The stackable cup assembly includes a plurality of containers and at least one lid. Each container includes an open top, a closed bottom base, and a sidewall extending between the open top and the base. The open top, the base, and the sidewall define a cavity of the container. Each container further includes a first coupling mechanism defined about an inner surface of the container proximate the open top. The at least one lid is configured to removably couple to a top container of the plurality of containers in a stacked configuration of the containers. The at least one lid includes a lower portion configured to be received within the cavity of the top container to couple the at least one lid to the top container at the first coupling mechanism of the top container.

In yet another aspect, a method for forming a stacked cup assembly from a plurality of cup assemblies is provided. The method includes providing a first container and a second container. Each container has an open top, a closed bottom base, and a sidewall extending between the open top and the base. The open top, the base, and the sidewall define a cavity of each container. The method further includes positioning the base of the first container into the open top of the second container, and coupling an outer surface of the first container proximate the base of the first container to an inner surface of the second container proximate the open top of the second container. A lower portion of a lid is inserted within the cavity of the first container, and the lower portion of the lid is coupled to an inner surface of the first container proximate the open top of the first container.

BRIEF DESCRIPTION OF THE DRAWINGS

FIG. 14 is a perspective view of the stackable cup assembly in the stacked configuration.

FIG. 15 is a front elevation of the stackable cup assembly shown in FIG. 14.

FIG. 16 is a rear elevation of the stackable cup assembly shown in FIG. 14.

FIG. 17 is a right side elevation of the stackable cup assembly shown in FIG. 14.

FIG. 18 is a left side elevation of the stackable cup assembly shown in FIG. 14.

FIG. 19 is a top plan view of the stackable cup assembly shown in FIG. 14.

FIG. 20 is a bottom plan view of the stackable cup assembly shown in FIG. 14.

FIG. 21 is a perspective view of a discrete cup assembly removed from the stackable cup assembly shown in FIG. 14.

FIG. 22 is a front elevation of the discrete cup assembly shown in FIG. 21.

FIG. 23 is a rear elevation of the discrete cup assembly shown in FIG. 21.

FIG. 24 is a right side elevation of the discrete cup assembly shown in FIG. 21.

FIG. 25 is a left side elevation of the discrete cup assembly shown in FIG. 21.

FIG. 26 is a top plan view of the discrete cup assembly shown in FIG. 21.

FIG. 27 is a bottom plan view of the discrete cup assembly shown in FIG. 21.

DETAILED DESCRIPTION OF THE INVENTION

Figure 1:
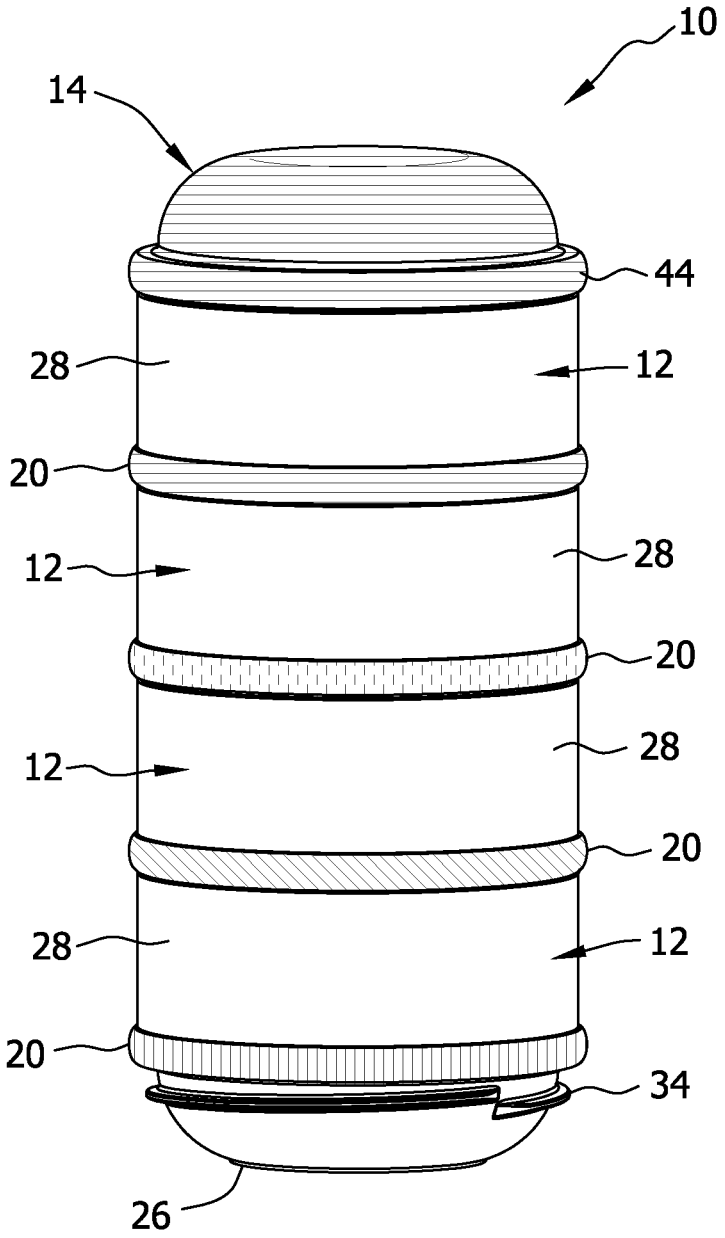
FIG. 1 is an upright side view of a stackable cup assembly of one suitable embodiment in a stacked configuration, wherein the stackable cup assembly includes a plurality of containers and a plurality of lids.
Figure 2:
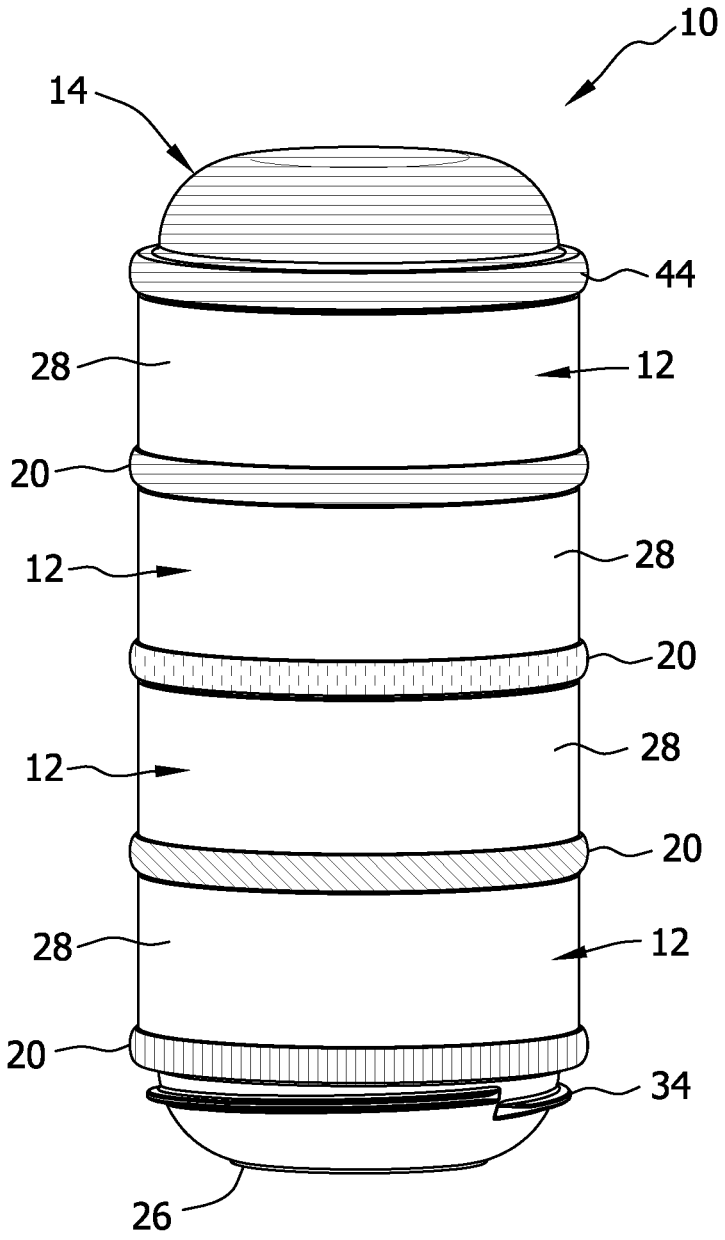
FIG. 2 is another side view of the stackable cup assembly shown in FIG. 1.
Figure 3:
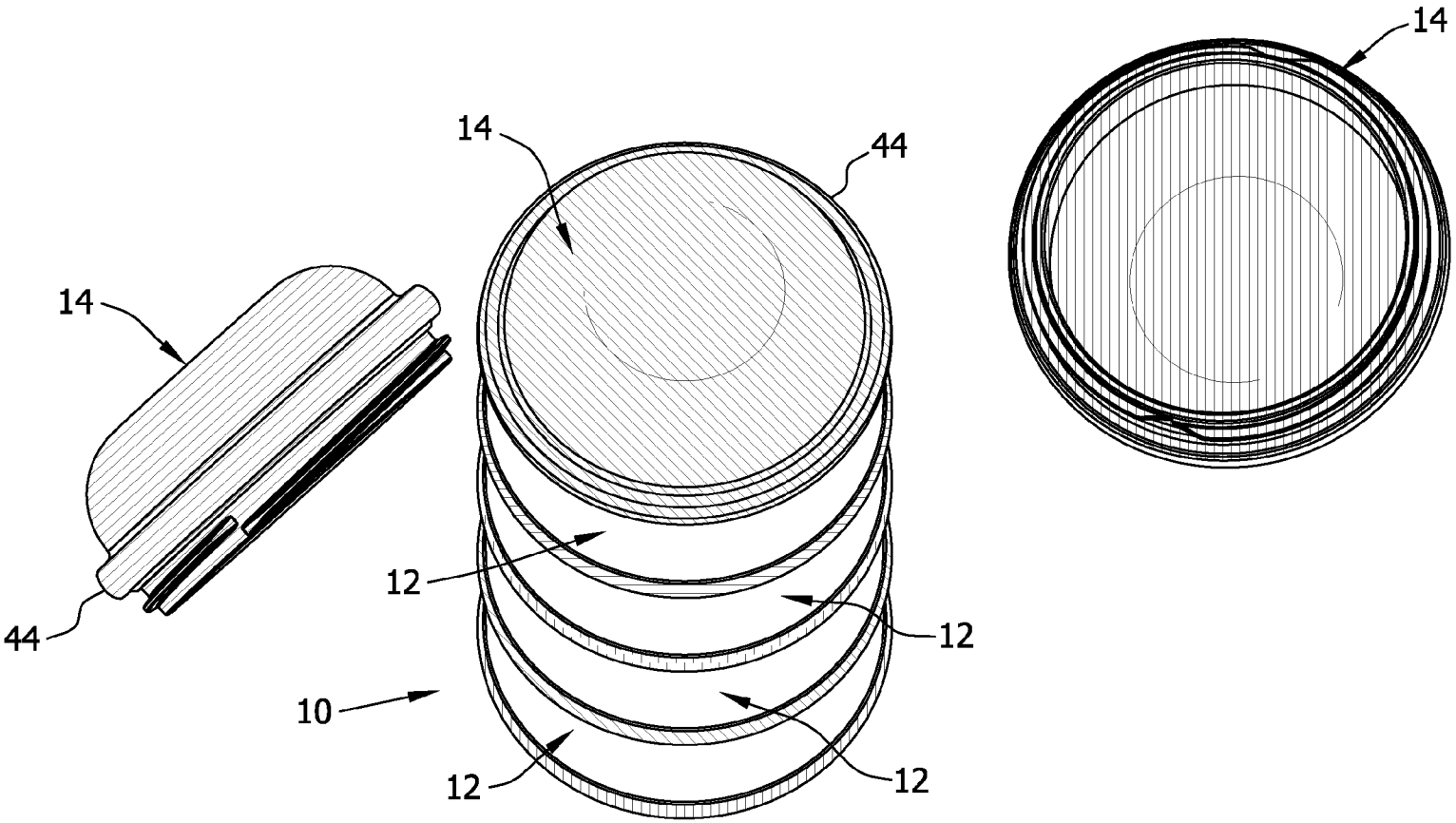
FIG. 3 is a perspective top view of the stackable cup assembly shown in FIG. 1.
Figure 4:
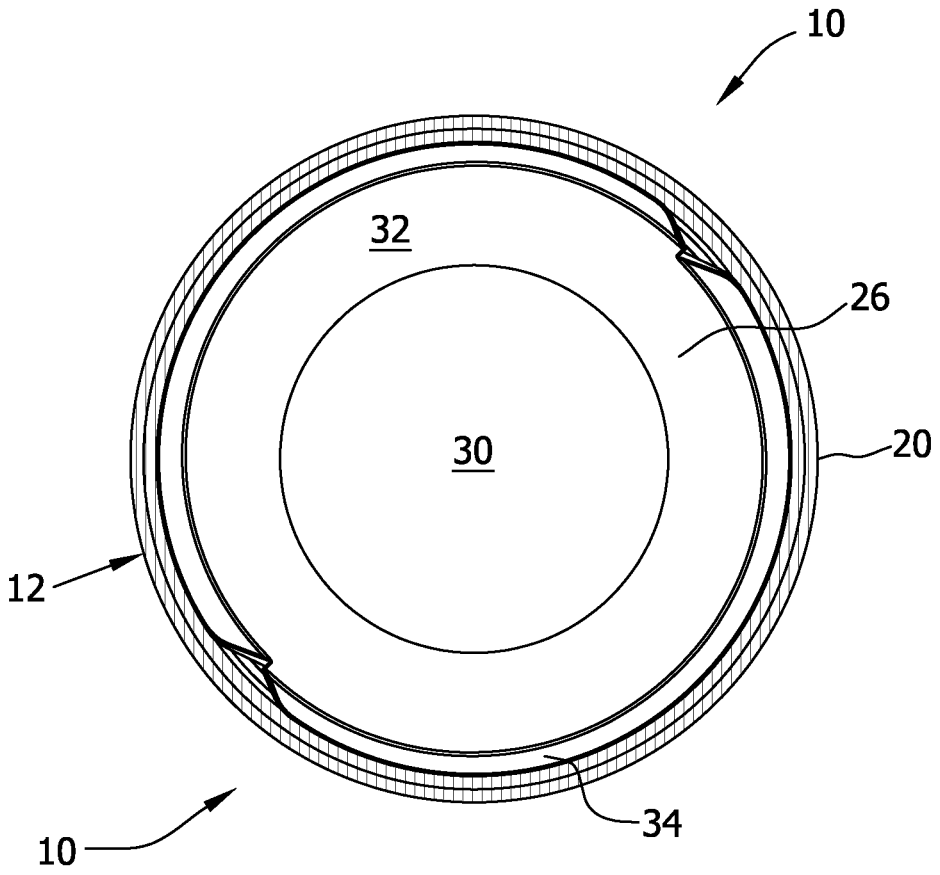
FIG. 4 is a bottom view of the stackable cup assembly shown in FIG. 1.

FIGS. 1-6 illustrate one suitable embodiment of a stackable cup assembly, generally indicated at 10. The stackable cup assembly 10 includes a plurality of individual containers (e.g., four), indicated generally at 12, and at least one lid, such as a plurality of lids (e.g., four—only one of the lids being in FIG. 1), indicated generally at 14, for closing each of the containers. Thus, in the illustrated embodiment, the number of containers 12 and the number of lids 14 are the same (i.e., four). It is understood that the stackable cup assembly 10 can include more or less than four containers 12 and lids 14 without departing from the scope of this invention. It is also understood that the number of containers 12 can differ from the number of lids 14. In one suitable embodiment (not shown), the stackable cup assembly 10 can have more containers 12 than lids 14. For example, the stackable cup assembly 10 can have four containers 12 and only two lids 14.

The illustrated containers 12 are substantially identical in size and shape, and the lids 14 are likewise substantially identical in size and shape such that the any one of the lids can be selectively engaged with any one of the containers. It is understood that some or all of the containers 12 may be of different sizes and shapes and all or some of the lids 14 may be sized and shaped to be received on only selected ones of the containers. As explained in more detail below, the only substantial difference between the illustrated containers 12 is the color of a colored band 20 (broadly, a colored portion) of the container. For example, a top container 12 has a blue colored band 20 (in the figures blue is indicated by horizontal line shading), a second from the top container 12 has a purple colored band 20 (in the figures purple is indicated by dashed vertical line shading), a second from the bottom container 12 has a green colored band 20 (in the figures green is indicated by diagonal line shading), and a bottom container 12 has a red colored band 20 (in the figures red is indicated by vertical line shading). In the exemplary embodiment, each container 12 has a matching colored lid 14. It should be understood that the containers 12 can be stacked in any order, and are not limited to the order described herein. It should also be understood that each lid 14 can fit on any container 12, and are not limited to being used with a matching colored container 12. However, in some embodiments, each lid 14 only fits on a matching colored container 12.

With reference to FIGS. 5-9, each of the containers 12 includes an open top 24, a closed bottom (or base) 26, and a sidewall 28 extending between the open top and the closed base. The sidewall 28 of each of the containers 12 is generally cylindrical, although it may have other shapes without departing from the scope of the present invention. Moreover, in the illustrated embodiment, the sidewalls 28 of the respective containers 12 have approximately the same height H (FIG. 8) but it is understood that one or more of the containers can have a different height without departing from the scope of this invention. Thus, one or more of the containers 12 can be shorter or taller than one or more of the other containers.

Figure 7:
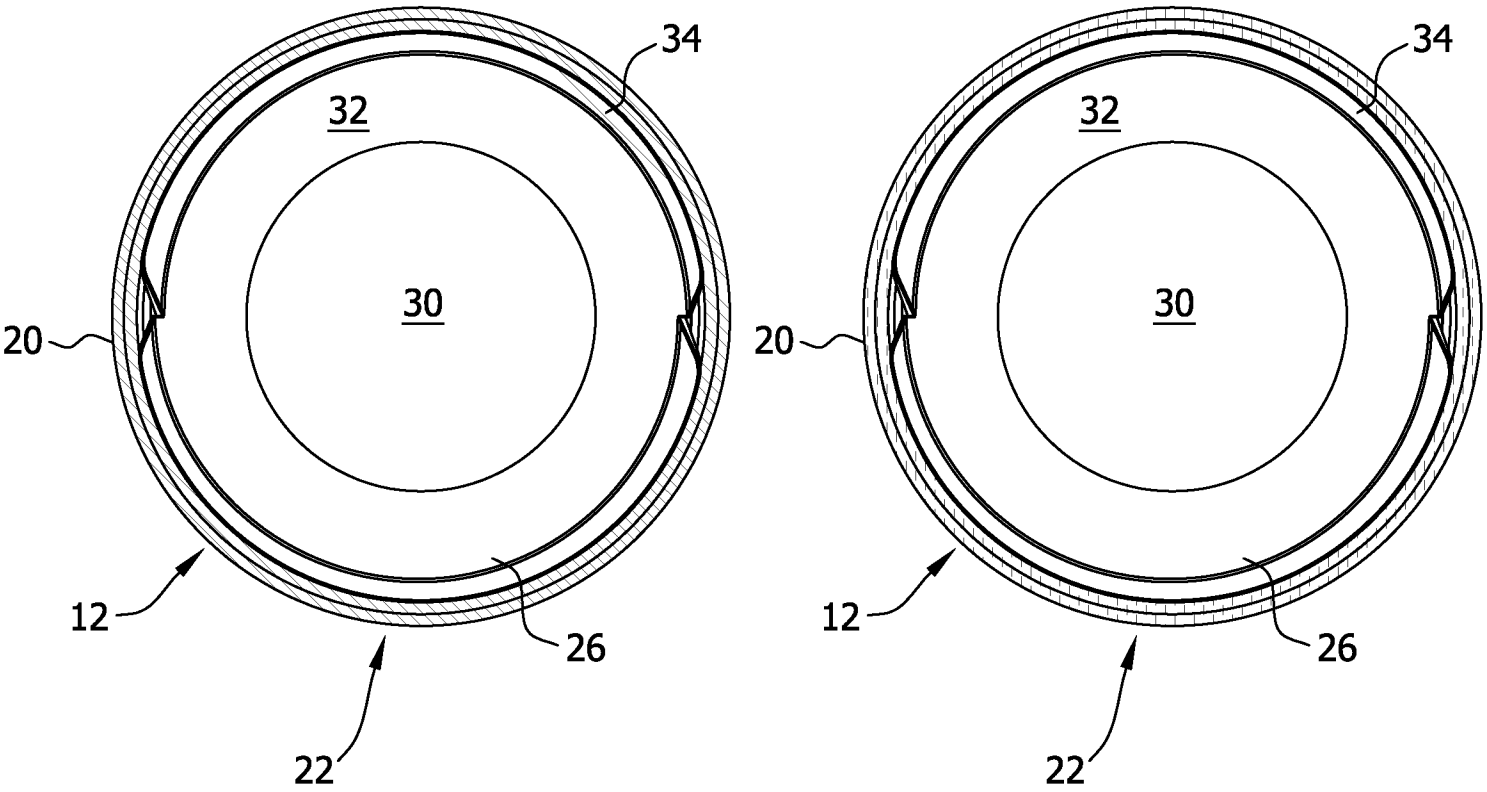
FIG. 7 is a bottom view of two containers of the stackable cup assembly.
Figure 8:
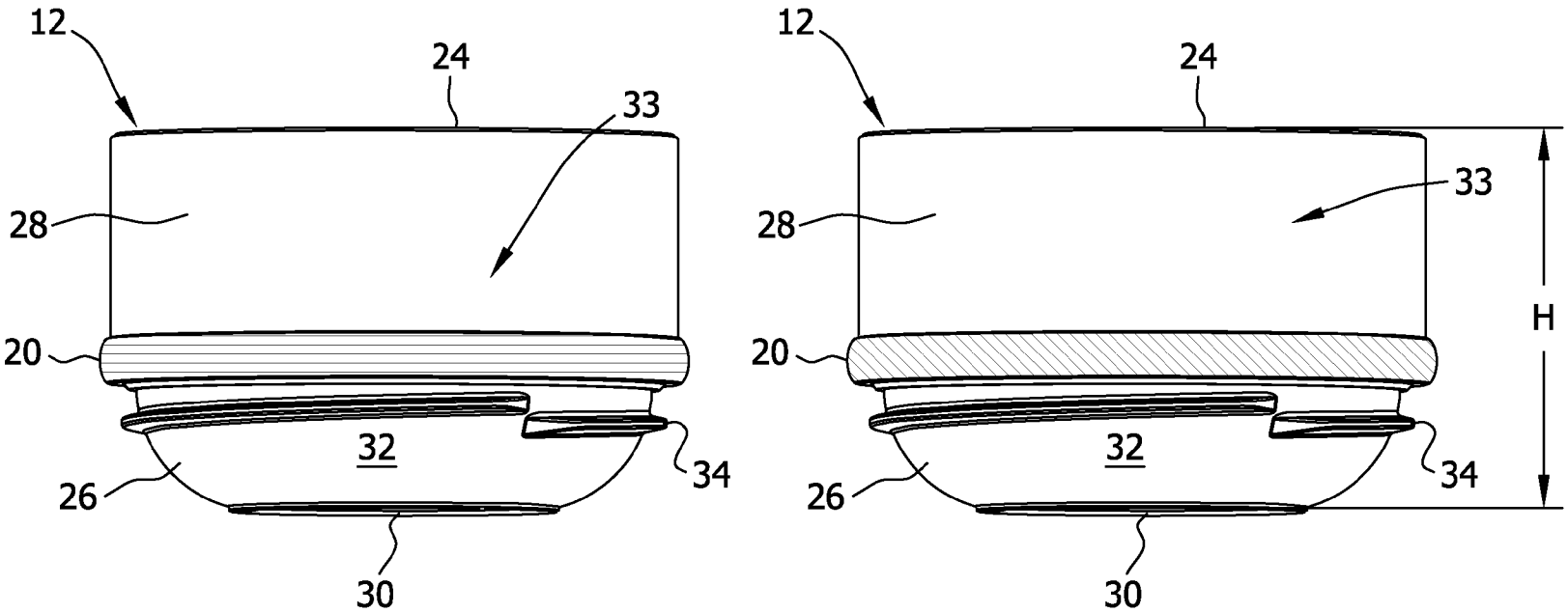
FIG. 8 is a side view of two containers of the stackable cup assembly.

As seen in FIGS. 7 and 8, the base 26 includes a generally circular, planar lower surface 30 so that the container body 22 can sit upright and not fall over when placed on a generally flat surface. It is understood that the lower surface 30 can be other than circular (e.g., square, triangular, rectangular). It is also understood that the lower surface 30 of the container 12 can be other than planar so long as the container is adapted to sit upright and not fall over when placed on a generally flat surface. A rounded or tapered surface 32 of the base 26 extends between the lower surface 30 of the base 26 and the sidewall 28. Each container 12 includes a coupling mechanism about an outer surface 33 of the container 12 proximate the base 26. The coupling mechanism is configured to couple to a coupling mechanism of a lower container 12, as described in more detail below. In the exemplary embodiment, the coupling mechanism includes external threads 34 that are disposed on the outer surface 33 of the container 12 at the tapered surface 32 generally adjacent the sidewall 28 of the container 12.

Figure 9:
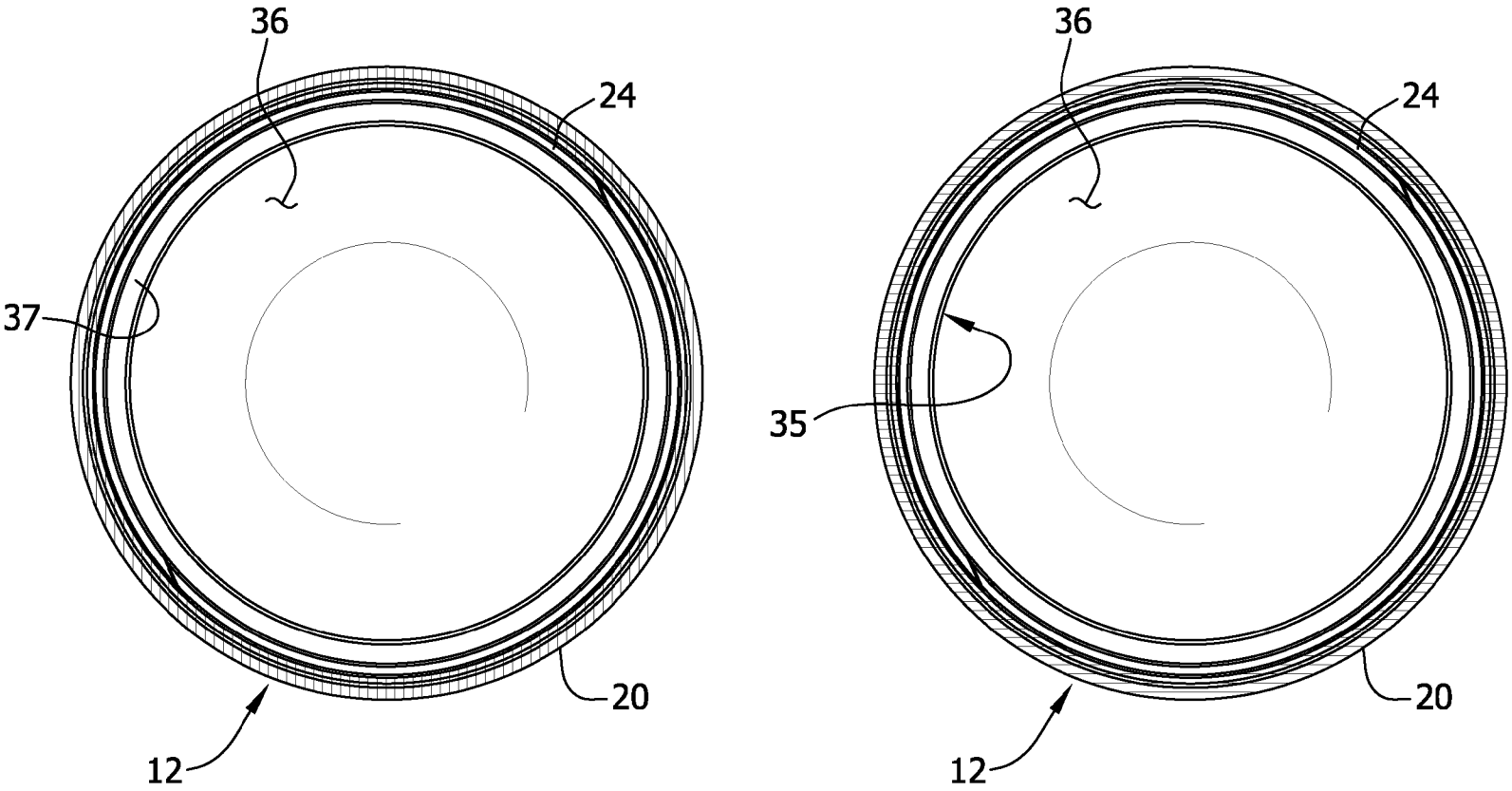
FIG. 9 is a top view of open tops of two containers of the stackable cup assembly.

As shown in FIG. 9, an inner surface 35 of the sidewall 28 and the base 26 together define a generally bowl-shaped cavity 36 extending from the open top 24 to the closed base 26. The cavity 36 is sized and shaped to receive and store one or more items therein. It is understood that the cavity 36 can be other than bowl-shaped without departing from the scope of this invention. In the exemplary embodiment, the container 12 includes a coupling mechanism defined about the inner surface 35 thereof proximate the open top 24. The coupling mechanism is configured to engage with the lower portion 40 of the lid 14 to couple the lid 14 to the container 12. In a particular embodiment, the coupling mechanism includes internal threads 37 that are located on the inner surface of the sidewall 28 of the container 12 proximate the open top 24. The internal threads 37 are configured to mate with the external threads 34 of the base 26 of another one of the containers 12 to thereby releasably attach two of the containers 12 together.

Figure 13:
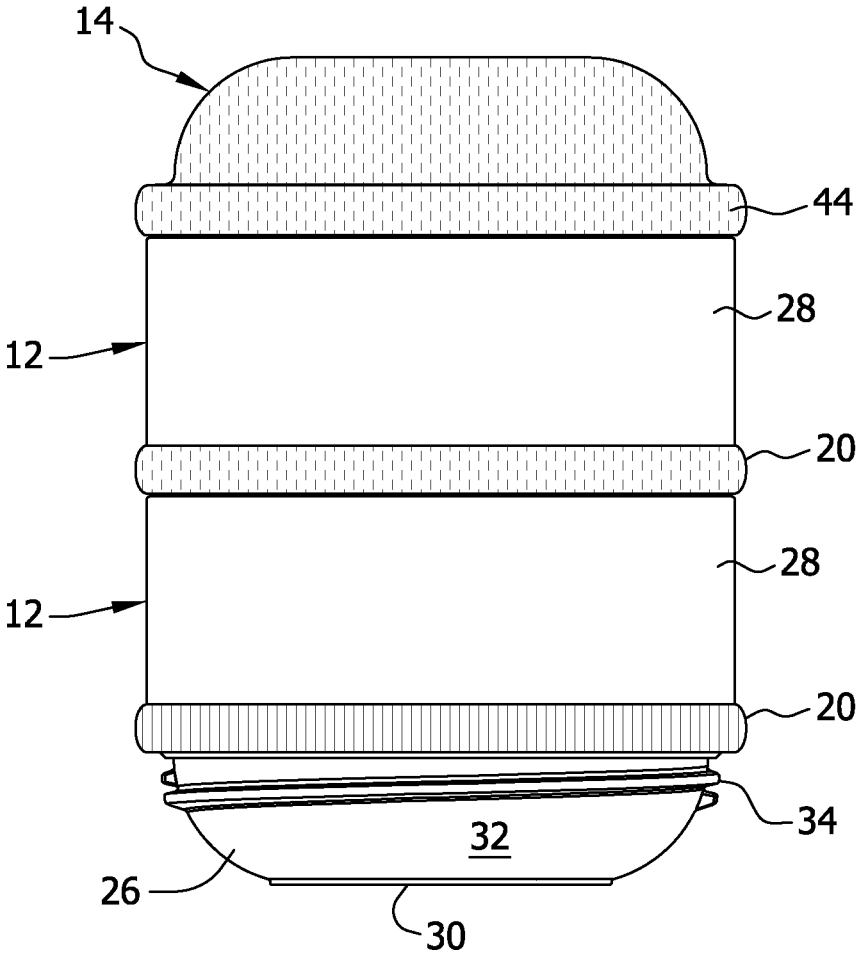
FIG. 13 is a side view of one of the containers and one of the lids secured to another one of the containers.
Figure 14:
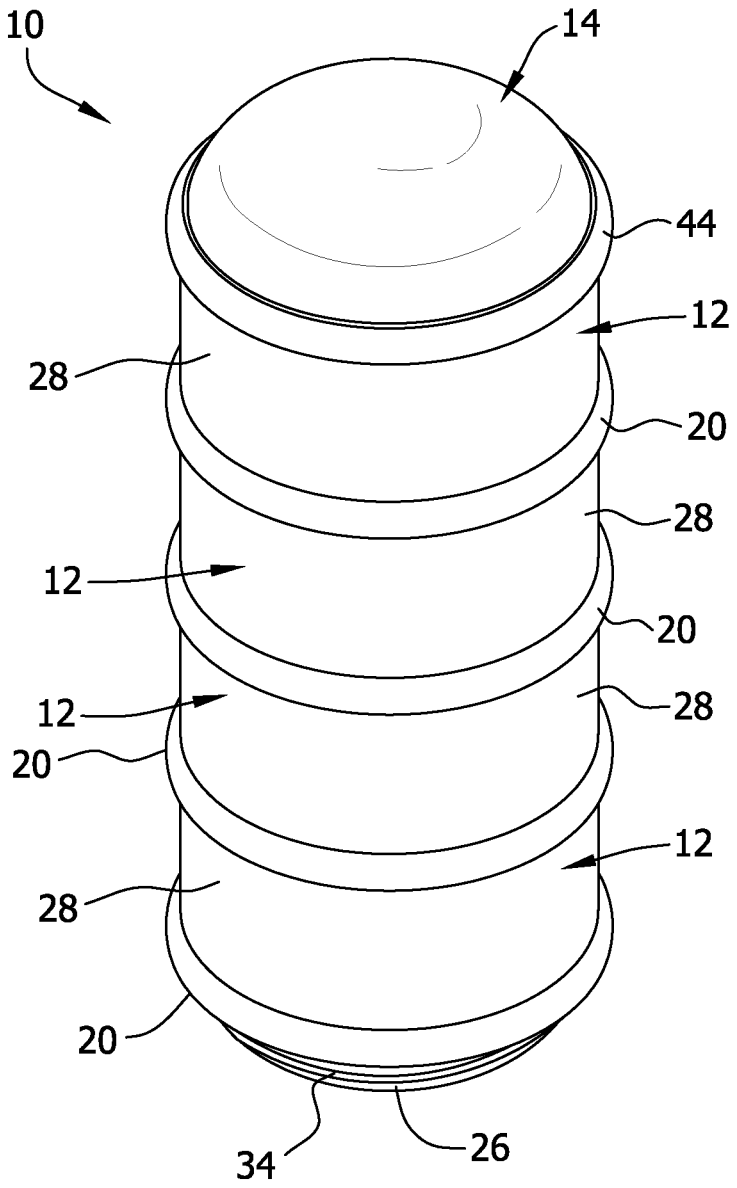
FIGS. 14-20 are drawings of the stackable cup assembly in the stacked configuration.
Figure 15:
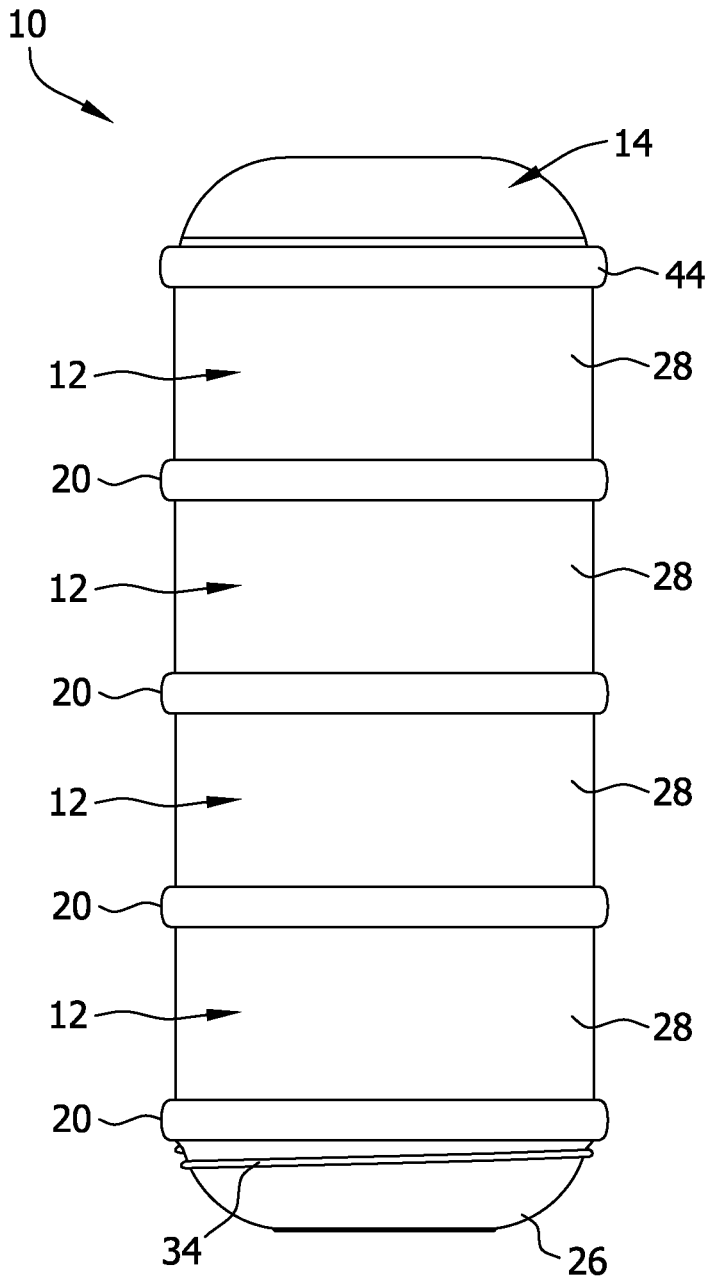
Figure 16:
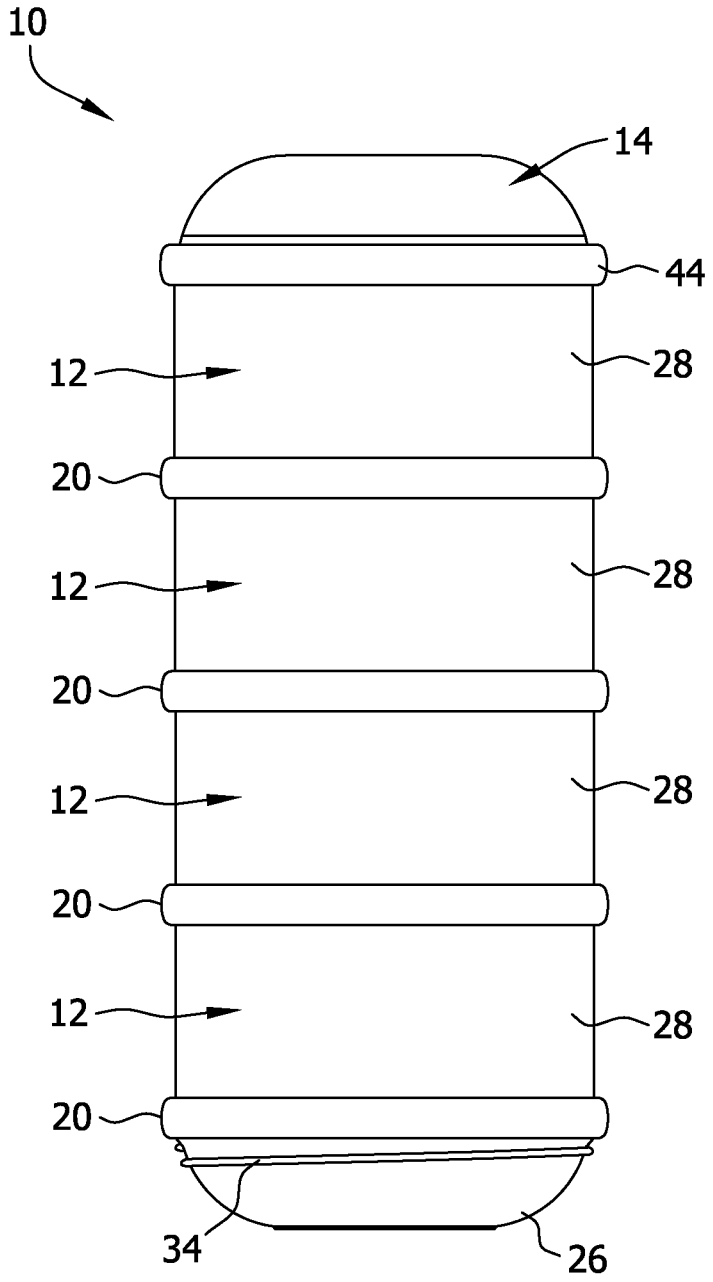
Figure 17:
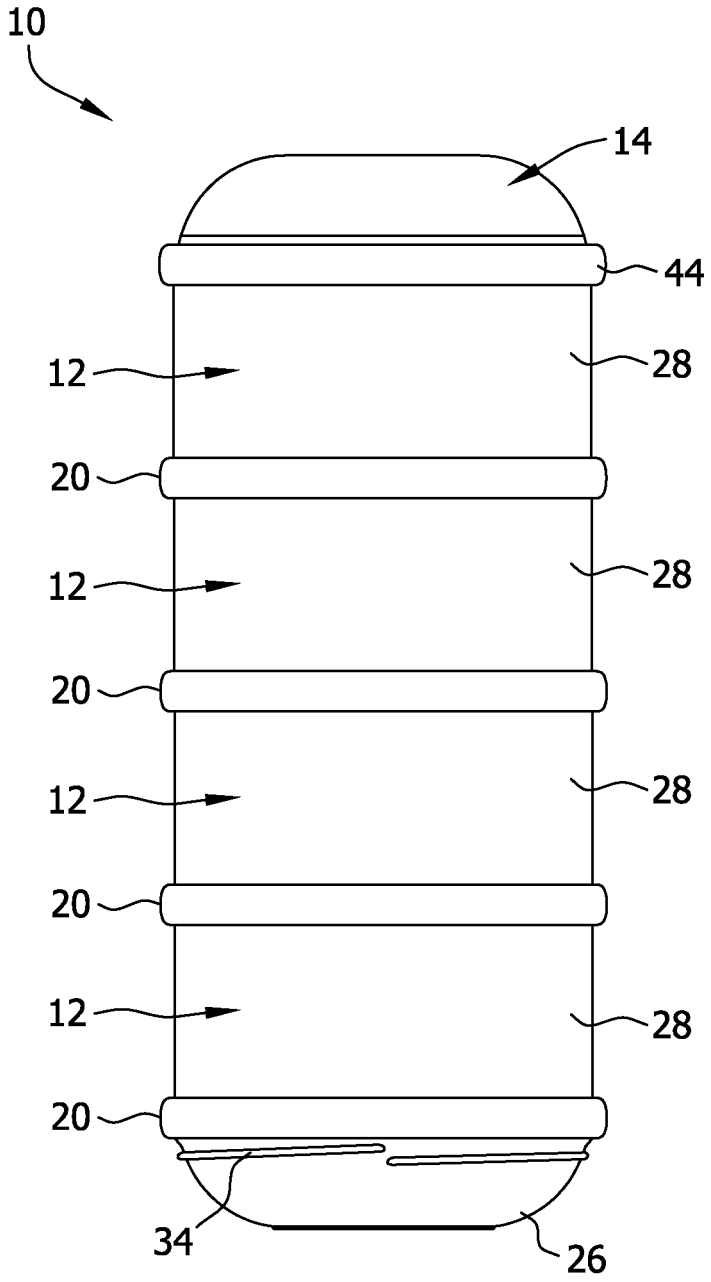
Figure 18:
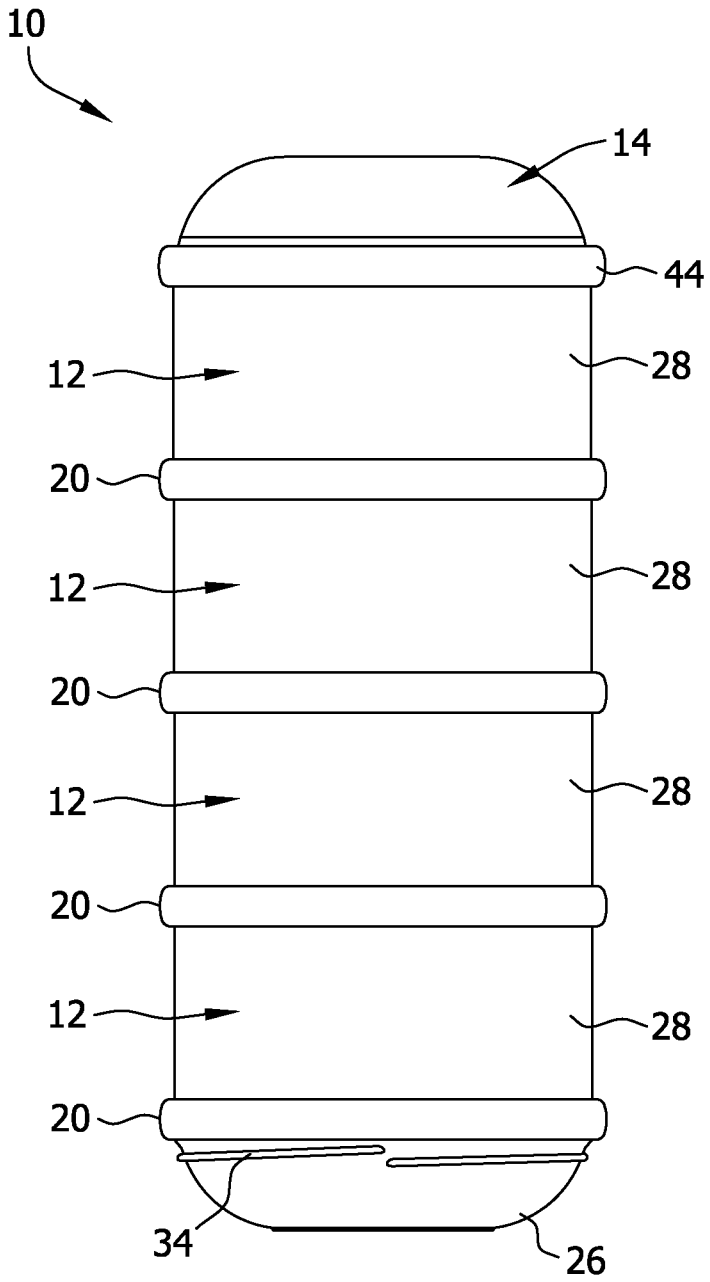
Figure 19:
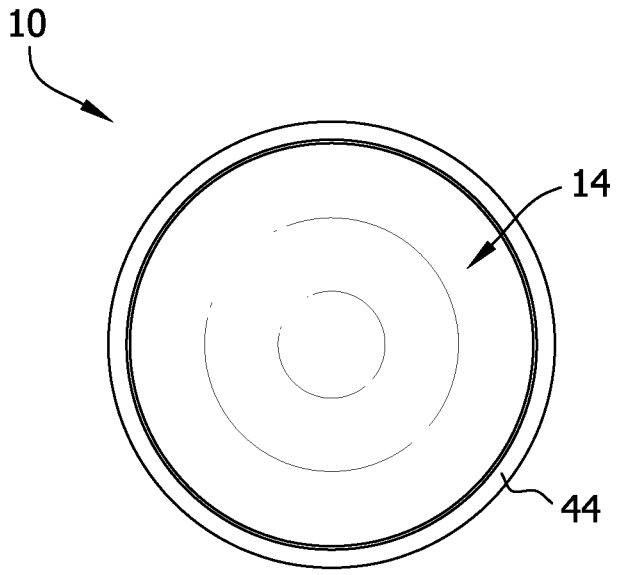
Figure 20:
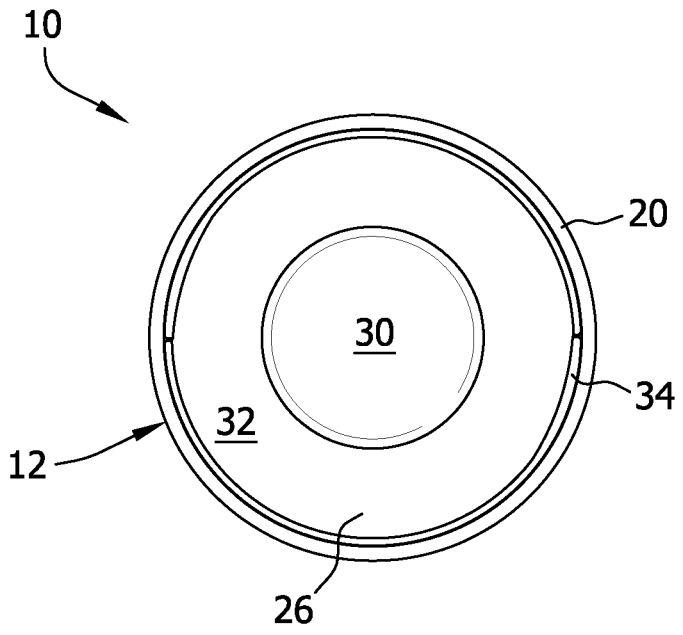
Figure 21:
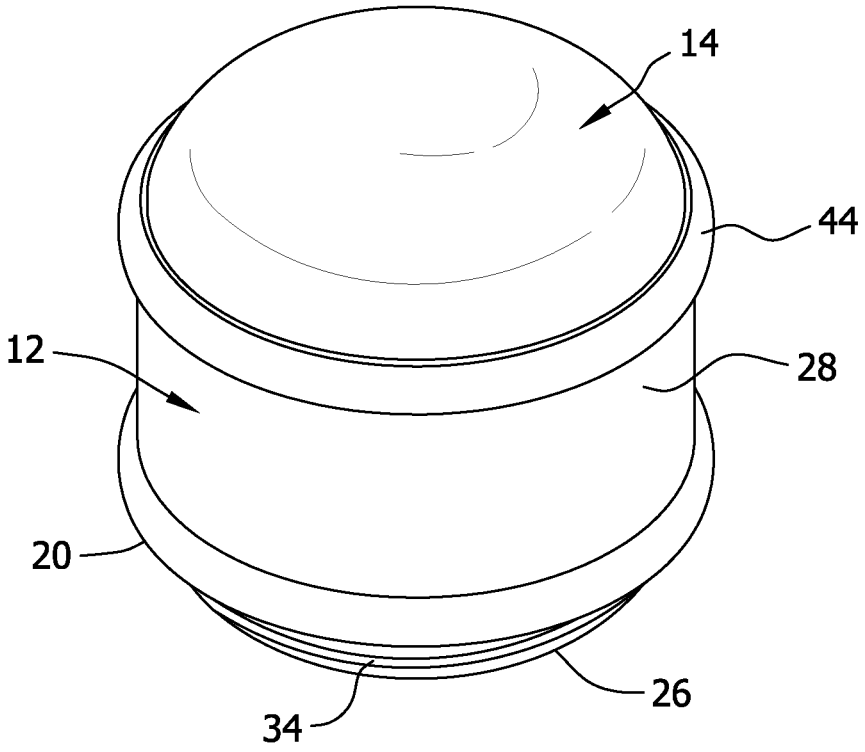
FIGS. 21-27 are drawings illustrating one lid and one container of the stackable cup assembly being used as a discrete receptacle.
Figure 22:
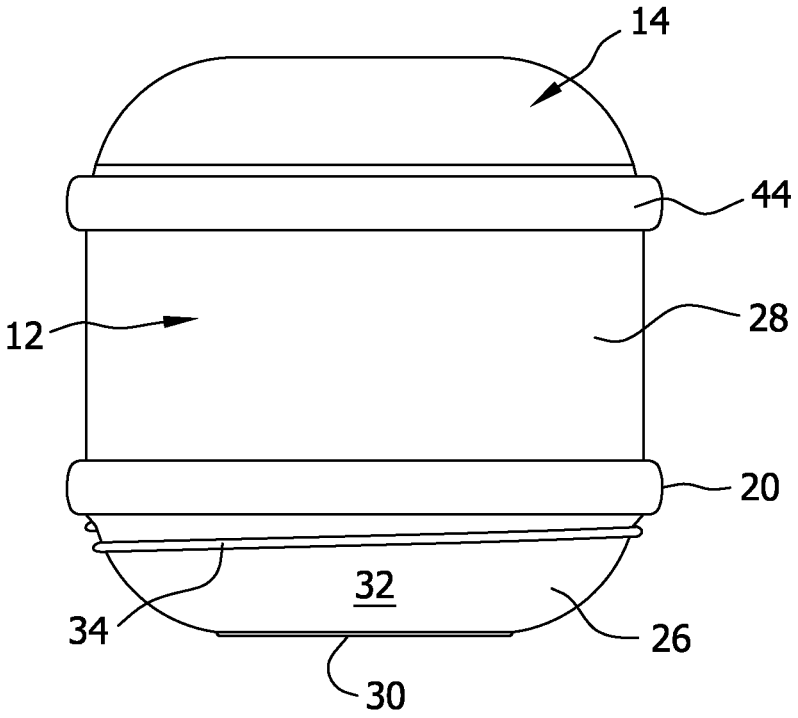
Figure 23:
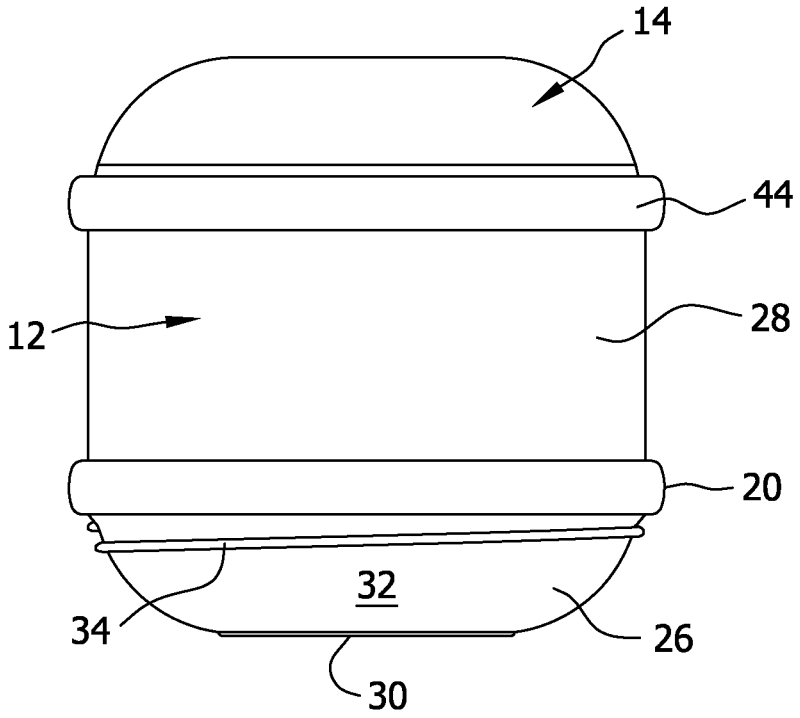
Figure 24:
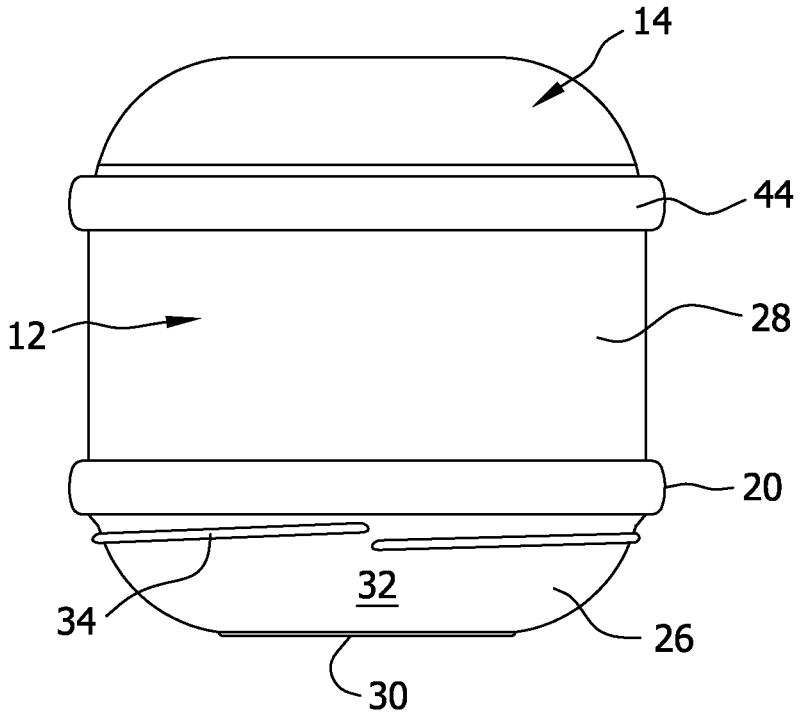
Figure 25:
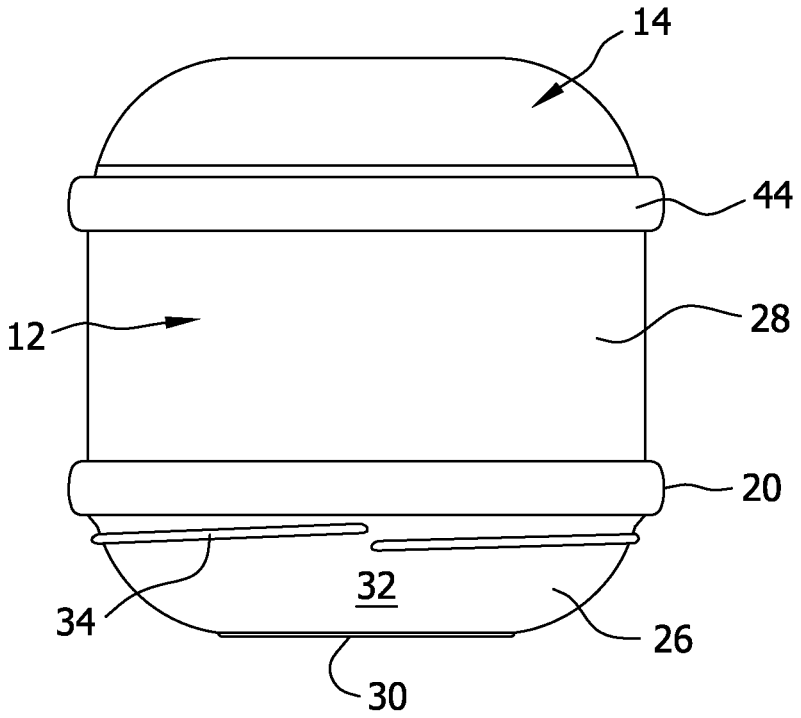
Figure 26:
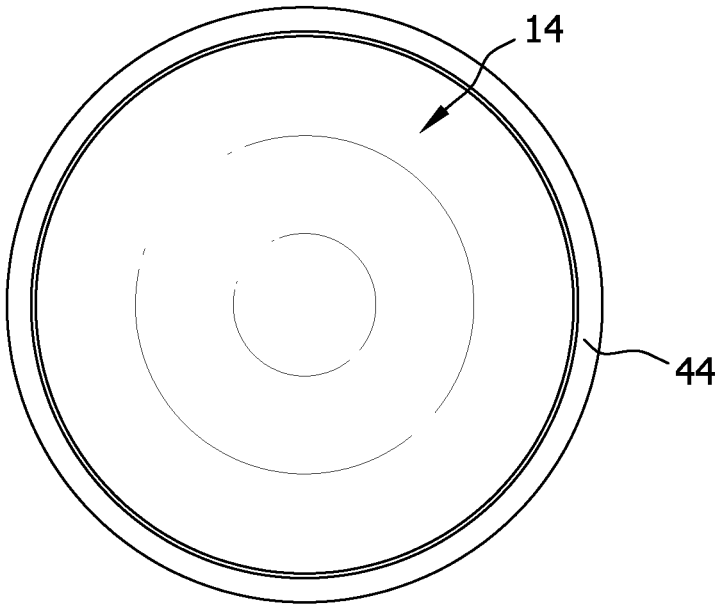
Figure 27:
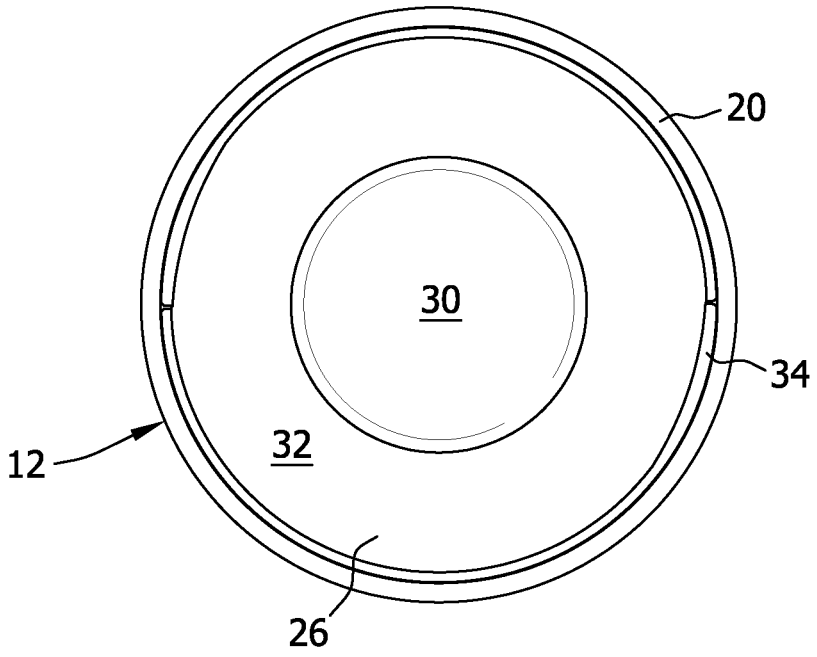

Two or more of the containers 12 of the stackable cup assembly 10 can be releasably attached together to define a stacked configuration of the stackable cup assembly. Additional containers 12 can be added to the stack by threadingly engaging additional containers 12 thereto. As seen in FIG. 13, the bottom 26 of the container 12 having its external threads 34 engaged to the internal threads 37 of another container 12 closes the open top 24 and thereby the cavity 36 of the other container 12. More specifically, the bottom 26 of the container 12 is received within the cavity 36 of the other container 12. It is contemplated, however, that the containers 12 can be releasably engaged to each other in any suitable manner (e.g., a snap-fit).

With reference again to FIGS. 5 and 6, each of the containers 12 includes the colored band 20 (broadly, a colored portion of the container) having a selected color that is different from each band on the other containers in the stackable cup assembly 10. It is understood that more than one (including all) of the containers 12 can have colored band 20 with the same color. In the illustrated embodiment, the colored band 20 is located on the sidewall 28 of the respective container 12. More specifically, the colored band 20 extends around a circumference of the sidewall 28 generally adjacent the base 26. It is understood that the colored bands 20 may be located on other portions of the containers 12 without departing from the scope of the present invention. The colors of the colored bands 20 in the illustrated embodiment are readily distinguishable from one another, and include such colors as blue, red, purple, and green. It is understood that other colors can be used. It is also understood that the containers 12 can include a different type of identification markings besides the colored bands that can be used to distinguish the containers from each other.

In one suitable embodiment, bands 20 form a sealing member. More specifically, the colored bands 20 of the containers 12 include, at least partially, an elastomeric material and, suitably, each of the colored bands 20 are made entirely of the elastomeric material. In one embodiment, the colored bands 20 are formed by overmolding the elastomeric material onto the sidewall 28 of the respective container 12, which is relatively rigid. It is understood that the colored bands 20 of the containers 12 can be made from other suitable materials and formed in other ways without departing from some aspects of this invention. Further, it should be understood that each band 20 can be formed from any suitable material that compresses against a portion of another container to form a water-tight seal, as described in more detail herein.

The container 12, or portions thereof, may be generally transparent to allow for identification of the items stored in the container without removing the lid, or the container body may be substantially opaque as illustrated in the various Figures. In one suitable embodiment, the container 12 can be formed (e.g., molded) from any suitable material that is FDA-compliant as a food-grade material for repeated use as a food contact product. In one suitable embodiment, the container 12 is both dishwasher and microwave safe.

Figure 10:
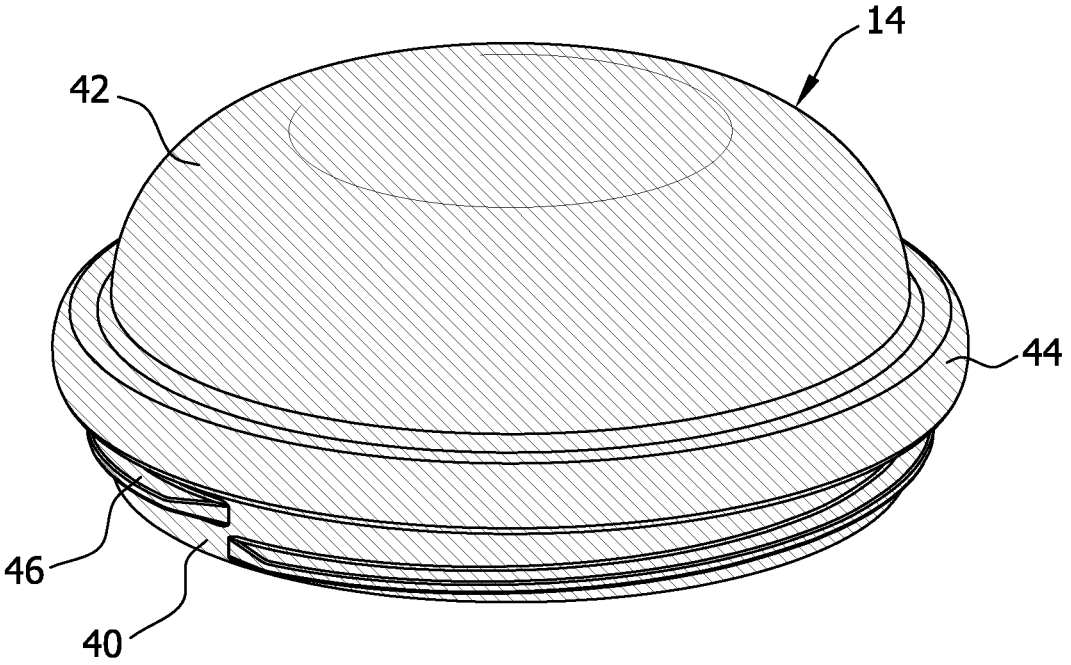
FIG. 10 is a side view of one of the lids of the stackable cup assembly.
Figure 11:
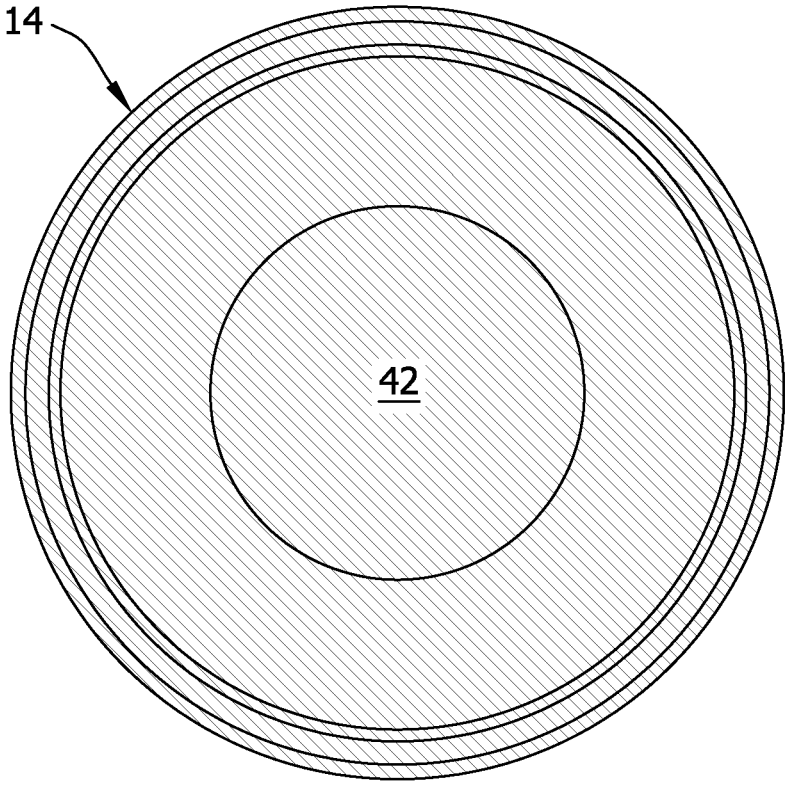
FIG. 11 is a top view of the lid shown in FIG. 10.

The lids 14 of the stackable cup assembly 10 are selectively attachable to any one of the containers 12 for closing the respective open top 24 and thereby the cavity 36 to retain any items stored therein and detachable for opening the open top 24 and thereby the cavity 36 to allow access to any items stored therein. Because the containers 12 and the lids 14 of the illustrated embodiment are substantially identical structurally to the other containers and lids, any lid can be selectively attached to any one of the containers. As seen in FIGS. 10 and 11, the lid 14 has a lower portion 40, an upper portion 42 (e.g., a dome-shaped upper portion), and a colored band 44 intermediate the lower and upper portions. The lower portion 40 of the lid 14 includes a coupling mechanism, such as external threads 46, for mating with the internal threads 37 of the sidewall 28 of the container 12 to thereby releasably attach the lid 14 to the container 12. It is contemplated, however, that the lid 14 can be releasably attached to the container 12 in any suitable manner (e.g., a snap-fit).

The colored band 44 (broadly, a colored portion) of the lid 14 has a selected color that is different from each band on the other lids in the illustrated stackable cup assembly 10. It is understood that one or more (including all) of the lids 14 can have the same color colored bands 44. In the illustrated embodiment, the colored bands 44 generally match the color of the lid 14 and extend around a circumference of the lid. It is understood that the colored bands 44 may be formed on other portions of the lid 14 without departing from the scope of the present invention. The colored bands 44 on each of the lids 14 and the colored bands 20 on each of the corresponding containers 12 include matching colors. It is understood, however, that the lids 14 can be placed on any of the containers 12 and not necessarily the container having same colored band 20, 44. The colors of the colored bands 44 in the illustrated embodiment are readily distinguishable from one another, and may include such colors as blue, red, purple, and green but other colors can be used. It is understood that different portions of the lid 14 can be colored without departing from the scope of the present invention.

In one suitable embodiment, each bands 44 forms a sealing member. More specifically, the colored bands 44 of the lids 14 each includes, at least partially, an elastomeric material and, suitably, each of the colored bands 44 are made entirely of the elastomeric material. In one embodiment, the colored bands 44 are formed by overmolding the elastomeric material onto the respective lid 14, which is relatively rigid. It is understood that the colored bands 44 of the lids 14 can be made from other suitable materials and formed in other ways without departing from some aspects of this invention. Further, it should be understood that each band 44 can be formed from any suitable material that compresses against a portion of another container to form a water-tight seal, as described in more detail herein.

The lid 14 may be substantially opaque, semi-opaque (as seen in the accompanying figures), or may be generally transparent. In one suitable embodiment, the lid 14 may be formed (e.g., molded) from any suitable material that is FDA-compliant as a food-grade material for repeated use as a food contact product. In one suitable embodiment, the lid 14 is both dishwasher and microwave safe.

Figure 5:
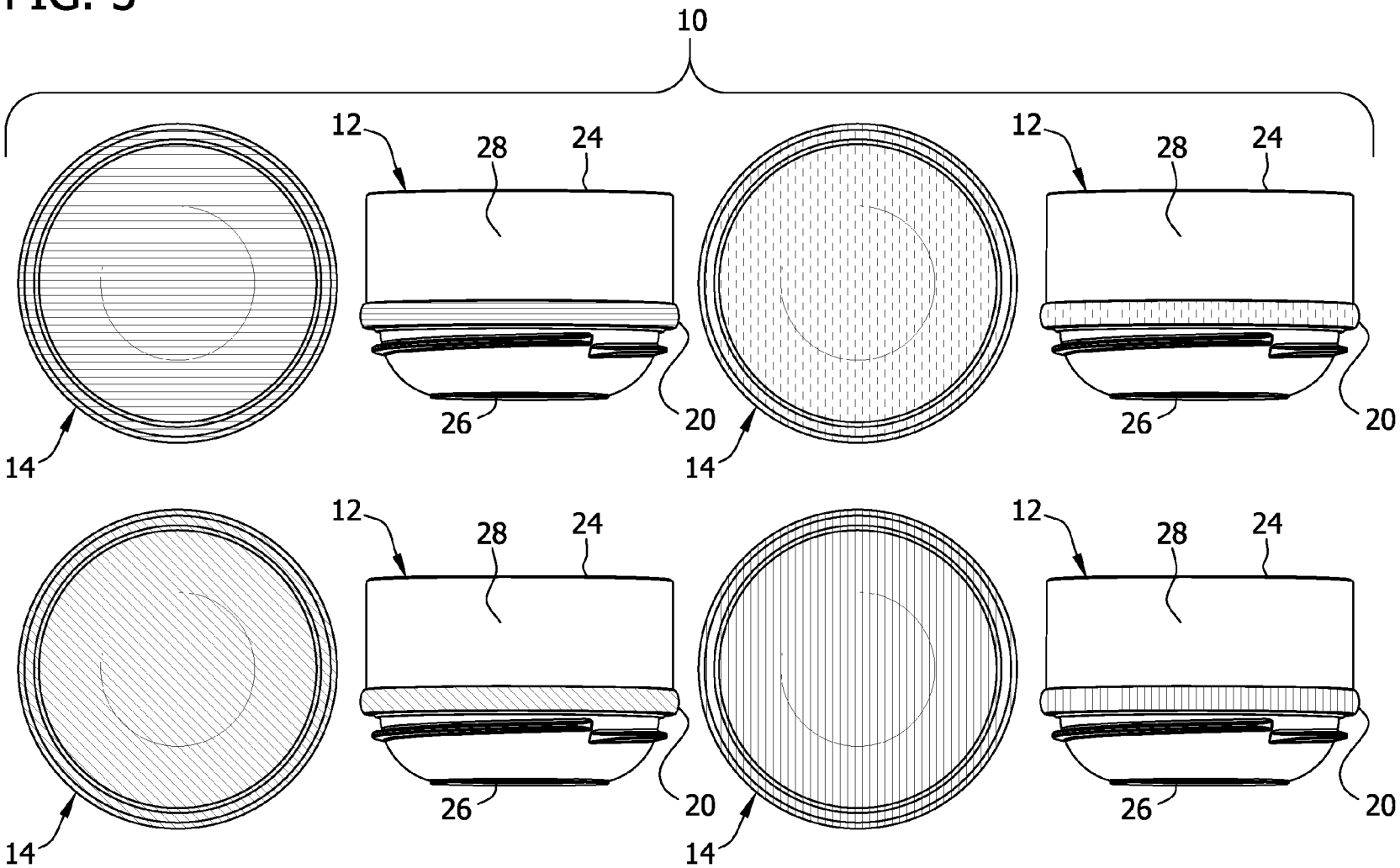
FIG. 5 is a first view of the stackable cup assembly shown in FIGS. 1-4 with the containers and lids disengaged from each other.
Figure 6:
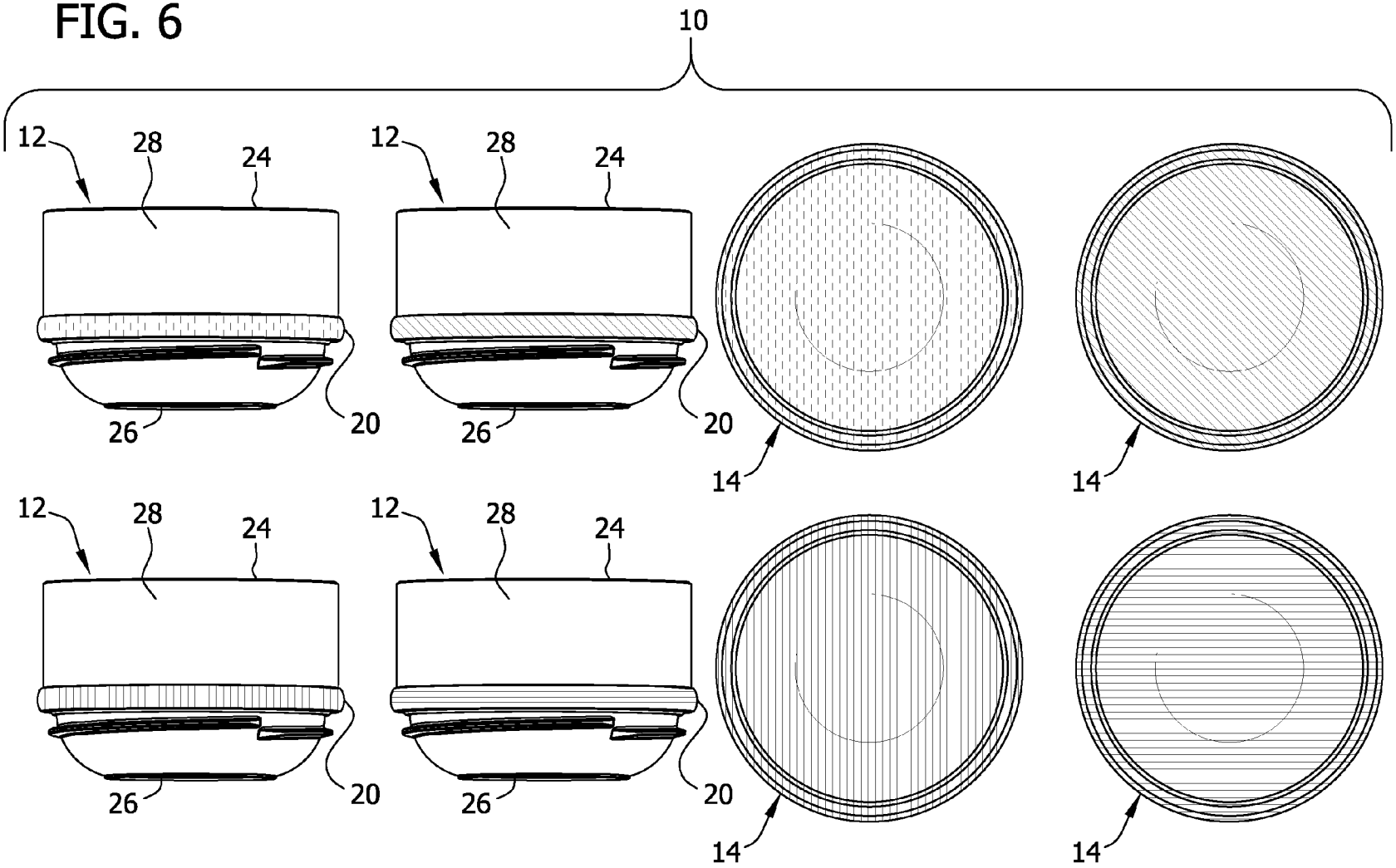
FIG. 6 is a second view of the stackable cup assembly shown in FIGS. 1-4 with the containers and lids disengaged from each other.

Each of the containers 12 of the stackable cup assembly 10 can be used individually or paired with one or more the other containers. For example, each of the containers 12 can be matched up with one of the lids 14 and used as an individual, discrete receptacle as is illustrated in FIGS. 12 and 21-27. In the illustrated embodiment, the stackable cup assembly 10 can be used to form four discrete receptacles (FIG. 5). It is understood, however, that the stackable cup assembly 10 can be configured to form more or fewer discrete receptacles than four. Use of the containers 12 and lids 14 to form discrete receptacles is referred to herein as an unstacked configuration of the stackable cup assembly 10.

Figure 12:
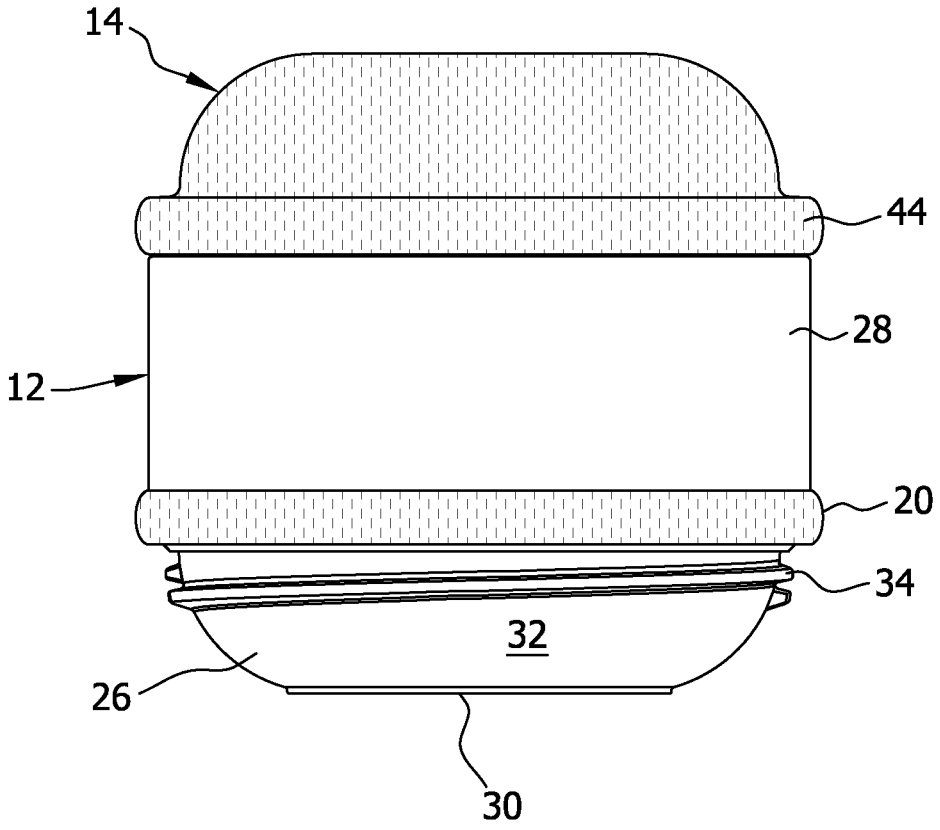
FIG. 12 is a side view of one of the lids secured to one of the containers.

As seen in FIG. 12, when the lid 14 is attached to the container 12, the lower portion 40 of the lid 14 extends below the open top 24 of the container and is received within the cavity 36 of the container. The colored band 44 of the lid 14 is disposed adjacent to an upper edge of the sidewall 28 of the container 12. The lid 14 is adapted to form a water-tight seal with the container 12. In the illustrated embodiment, the water-tight seal between the lid 14 and the container 12 is formed by the elastomeric colored band 44 of the lid being engaged with and/or compressed against the upper edge of the sidewall 28 of the lower container (FIG. 12). Thus, the colored bands 44 of the lids act as a gasket when the lids are attached to one of the containers 12. As a result, the containers 12 and lids 14 can be used as discrete receptacles to hold solids, particular/granular substances, semi-solids, and liquids.

With reference now to FIGS. 1-3 and 13, one or more of the containers 12 can be paired up and used with one or more of the other containers. For example, FIG. 13 shows two containers 12 being used together and in combination with one of the lids 14. As seen therein, one of the containers 12 (i.e., the lower container having a red colored band as viewed in FIG. 13) is threadingly engaged to the other (i.e., the upper container having a purple colored band as viewed in FIG. 13). As explained above, the bottom 26 of the upper container 12 closes the open top 24 and thereby the cavity 36 of the lower container. Two or more of the containers 12 being engaged together can be referred to as a stacked configuration of the stackable cup assembly 10. One or more of the remaining containers 12 can be threadingly engaged to either the upper or lower container to form a larger stack of containers. For example, FIGS. 1-4 and 14-20 illustrate four containers 12 in the stacked configuration of the stackable cup assembly 10.

In one suitable embodiment, the engagement between adjacent containers 12 in the stacked configuration of the stackable cup assembly 10 forms a water-tight seal. In the illustrated embodiment, the water-tight seal between adjacent containers 12 is formed by the elastomeric colored band 20 of the upper container being engaged with and/or compressed against an upper edge of the sidewall 28 of the lower container (FIG. 13). Thus, the colored bands 20 of the containers act as a gasket when the containers are stacked. As a result, the containers 12 of the stackable cup assembly 10 can be used to hold solids, particular/granular substances, semi-solids, and liquids.

It is understood that any suitable items can be placed into and stored with the containers 12 of the stackable cup assembly 10 whether the containers and lids are used in the stacked configuration or the unstacked configuration. In one suitable use, the stackable cup assembly 10 is adapted for use with babies, toddlers, or small children. In such a configuration, the containers can be used to separately store one or more food item and/or one or more non-food item. Suitable food items that can be stored in one or more of the containers include, but not limited to, water, juice, infant formula, crackers, pretzels, cookies, cereal, apple sauce, ranch dressing, candy, fruit, vegetables, and pureed or mashed fruits and/or vegetables.

A method for forming a stackable cup assembly from a plurality of cup assemblies includes providing a first container 12 and a second container 12. Each container 12 has the open top 24, the base 26, and the sidewall 28 extending between the open top 24 and the base 26. The open top 24, the base 26, and the sidewall 28 define the cavity 36 of each container 12.

The base 26 of the first container 12 is positioned into the open top 24 of the second container 12, and an outer surface of the first container 12 proximate the base 26 of the first container 12 to an inner surface of the second container 12 proximate the open top 24 of the second container 12. More specifically, a first coupling mechanism of the first container 12, such as external threads 34, is coupled to a second coupling mechanism of the second container 12, such as the internal threads 37. Further, a water-tight seal is formed between the elastomeric band 20 of the first container 12 and the open top 24 of the second container 12. The elastomeric band 20 is positioned about the outer surface of the first container 12 proximate to the base 26.

The lower portion 40 of the lid 14 is inserter within the cavity 36 of the first container 12, and the lower portion 40 is coupled to an inner surface of the first container 12 proximate the open top 24 of the first container 12. A water-tight seal is formed between the elastomeric band 44 of the lid 14 and the open top 24 of the first container 12. The elastomeric band 44 is positioned about an upper end of the lower portion 40 of the lid 14.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A cup assembly configured to be coupled to a second cup assembly, the cup assembly comprising:

a container comprising an open top, a closed bottom base, and a sidewall extending between the open top and the base, wherein the open top, the base, and the sidewall define a cavity of the container; and a lid configured to removably couple to the container, the lid comprising a lower portion configured to be received within the cavity of the container to couple the lid to the container, the lid also comprising an elastomeric band retained on the lid when decoupling the lid from the container, the band extending circumferentially about an upper end of the lid lower portion, the band configured to sealingly engage an outer surface of the container proximate the open top to form a water-tight seal between the lid and the container.

2. A cup assembly in accordance with claim 1, wherein the container further comprises a coupling mechanism defined about an inner surface of the container proximate the open top, the coupling mechanism configured to engage with the lower portion of the lid to couple the lid to the container.

3. A cup assembly in accordance with claim 1, wherein the container further comprises a coupling mechanism defined about an outer surface of the container proximate the base, the coupling mechanism configured to couple the container to the second cup assembly.

4. A cup assembly in accordance with claim 3, wherein the container further comprises an elastomeric band extending circumferentially about the outer surface of the container proximate to an upper end of the coupling mechanism, the band configured to sealingly engage an outer surface of a container of the second cup assembly proximate an open top thereof to form a water-tight seal between the container and the container of the second cup assembly.

5. A cup assembly in accordance with claim 1, wherein the base of the container comprises a lower planar surface and a tapered surface extending between the lower planar surface and the sidewall.

6. A cup assembly in accordance with claim 5, wherein the tapered surface comprises threads configured to couple the container to an inner surface of a container of the second cup assembly.

7. A stackable cup assembly comprising:

a plurality of containers, each container comprising:

an open top, a closed bottom base, and a sidewall extending between the open top and the base, wherein the open top, the base, and the sidewall define a cavity of the container; and a first coupling mechanism defined about an inner surface of the container proximate the open top;

at least one lid configured to removably couple to a top container of the plurality of containers in a stacked configuration of the containers, the at least one lid comprising a lower portion configured to be received within the cavity of the top container to couple the at least one lid to the top container at the first coupling mechanism of the top container, the at least one lid forming a water-tight seal with the container; and a second coupling mechanism about an outer surface of each container proximate the base, the second coupling mechanism configured to couple to the first coupling mechanism of a lower container of the plurality of containers, wherein the base of each container of the plurality of containers comprises a lower planar surface and a tapered surface extending between the lower planar surface and the second coupling mechanism.

8. A stackable cup assembly in accordance with claim 7, wherein each container of the plurality of containers further comprises a sealing member extending circumferentially about the outer surface of the container proximate to an upper end of the second coupling mechanism, the sealing member configured to sealingly engage an outer surface of the lower container proximate an open top of the lower container to form a water-tight seal between the container and the lower container.

9. A stackable cup assembly in accordance with claim 7, wherein the first coupling mechanism and the second mechanism comprise respective threads.

10. A stackable cup assembly in accordance with claim 7, wherein the at least one lid further comprises a sealing member extending circumferentially about an upper end of the lid lower portion, the sealing member configured to sealingly engage an outer surface of the top container proximate the open top to form a water-tight seal between the at least one lid and the top container.

11. A stackable cup assembly in accordance with claim 7, wherein the tapered surface comprises threads configured to couple each container of the plurality of containers to the first coupling mechanism of a lower container of the plurality of containers.

12. A stackable cup assembly in accordance with claim 7, wherein each container of the plurality of containers is substantially identically sized.

13. A stackable cup assembly in accordance with claim 7, wherein the at least one lid comprises a plurality of lids.

14. A method for forming a stacked cup assembly from a plurality of cup assemblies, the method comprising:

providing a first container and a second container, each container having an open top, a closed bottom base, and a sidewall extending between the open top and the base, wherein the open top, the base, and the sidewall define a cavity of each container;

positioning the base of the first container into the open top of the second container;

coupling an outer surface of the first container proximate the base of the first container to an inner surface of the second container proximate the open top of the second container;

inserting a lower portion of a lid within the cavity of the first container;

coupling the lower portion of the lid to an inner surface of the first container proximate the open top of the first container; and forming a water-tight seal between an elastomeric band of the lid and the open top of the first container, the band extending circumferentially about an upper end of the lower portion of the lid.

15. A method in accordance with claim 14, wherein coupling an outer surface of the first container to an inner surface of the second container further comprises:

forming a water-tight seal between an elastomeric band of the first container and the open top of the second container, the band extending circumferentially about the outer surface of the first container proximate to the base.

16. A method in accordance with claim 14, wherein coupling an outer surface of the first container to an inner surface of the second container further comprises:

coupling a first coupling mechanism of the first container to a second coupling mechanism of the second container, wherein the first coupling mechanism defined about an outer surface of the container proximate the base thereof and the second coupling mechanism defined about an inner surface of the second container proximate the open top thereof.

* * * * *